US005987945A

United States Patent [19]

Ruano Aramburu

[11] Patent Number: 5,987,945

[45] Date of Patent: Nov. 23, 1999

[54] SECURITY CLOSURE FOR CONTROL OF ACCESS

[75] Inventor: Luis Angel Ruano Aramburu, San Sebastian, Spain

[73] Assignee: Talleres De Escoriaza, S.A., Spain

[21] Appl. No.: 09/009,171

[22] Filed: Jan. 20, 1998

[30] Foreign Application Priority Data

Feb. 27, 1997 [ES] Spain ..... 9700430

[51] Int. Cl.[6] ..... E05B 47/00

[52] U.S. Cl. ..... 70/277; 70/107; 70/279.1; 70/218; 70/278.1

[58] Field of Search ..... 70/279.1, 218, 70/219, 220, 278.3, 278.7, 283, 283.1, 107, 110, 111, 371, 370, 451, 277, 224

[56] References Cited

U.S. PATENT DOCUMENTS

| | | | |
|---|---|---|---|
| 1,684,230 | 9/1928 | Lach | 70/370 |
| 3,390,558 | 7/1968 | Tornoe et al. | 70/107 |
| 3,455,129 | 7/1969 | Forbes et al. | 70/370 |
| 3,881,331 | 5/1975 | Tranberg et al. | 70/218 |
| 4,276,760 | 7/1981 | Nolin | 70/107 |
| 4,429,556 | 2/1984 | Kambic | 70/218 |
| 4,820,330 | 4/1989 | Lin | 70/277 |
| 5,083,448 | 1/1992 | Kärkkäinen et al. | 70/107 |
| 5,457,975 | 10/1995 | Berger et al. | 70/370 |
| 5,475,996 | 12/1995 | Chen | 70/279.1 |
| 5,640,863 | 6/1997 | Frolov | 70/283 |
| 5,809,812 | 9/1998 | Gallego | 70/107 |

FOREIGN PATENT DOCUMENTS

| | | | |
|---|---|---|---|
| 0378124 | 7/1990 | European Pat. Off. | 70/107 |
| 0425431 | 5/1991 | European Pat. Off. | 70/107 |
| 3631118 | 3/1988 | Germany | 70/107 |
| 2262770 | 6/1993 | United Kingdom | 70/283 |

*Primary Examiner*—Darnell M. Boucher
*Attorney, Agent, or Firm*—Nields, Lemack & Dingman

[57] ABSTRACT

A safety closure for controlled access, that includes an inner and outer unit mounted on a door to drive a main bolt and a privacy bolt. The outer unit has an armored chassis with a primary tube of the actuating handle and carrying a secondary tube having a square axis that drives the main latch. A retractable tenon provides the connection between the primary and secondary tubes and a retractor treadle is in permanent contact with the retractable tenon and a rocker having elastic arms that drives the retractor treadle. A motorize actuator is activated by an electronic card reader. The motorized actuator or an emergency handle may actuate the rocker in opposite directions. The inner tube has first and second pushing tabs symmetrically arranged in mutual opposition whereby the pushing tabs act independently of each other in response to the direct or opposite turning of the inner actuating handle to actuate the privacy bolt. An emergency lock cylinder drives the emergency handle.

9 Claims, 6 Drawing Sheets

SECURITY CLOSURE FOR CONTROL OF ACCESS

FIELD OF THE INVENTION

The security closure to which this invention refers is intended to control access to restricted zones of agencies, industries, offices, premises, etc., by means of a personal identification card provided with a magnetic, optical or digital code of familiar type.

PRIOR STATE OF THE ART

A closure such as that offered should provide security elements which prevent its defeat as much as possible, by imparting high mechanical strength to the protective cover on the outside of the access being controlled and, preferably also, by means of devices which frustrate the forced opening of the closure mechanism if a so-called code card has not been previously validated.

It is also desirable that this type of closure be independent of the particular mechanical lock employed, i.e., that it be versatile for application to any conventional lock.

Other desirable properties are that the closure have a privacy bolt which can be actuated from the inside and in addition to the main bolt of the lock mechanism; a device which allows throwing the privacy bolt also from the outside, to establish a point of closure in addition to that of the main bolt; an emergency device which enables opening from the outside at any time by another exclusive means different from the valid code card, even when the privacy bolt has been thrown; and a no-panic device which enables opening from the inside under any circumstances.

The solutions presently known in this field do not bring together all mentioned features in a simple assemblage, and to construct such an assemblage by combining the known solutions would be excessively complicated and costly.

EXPLANATION OF THE INVENTION AND ITS ADVANTAGES

The new closure claimed comprises an outer and an inner unit, installed respectively on the outer and the inner side of a door to mechanically actuate the opening turning of a locking mechanism with various possible configurations, which is lodged in the body of said door and has a main bolt and a privacy bolt; said outer unit having an assemblage (comprised of different parts) of armored body, a primary tube carrying a handle, or knob, outer actuator, a secondary tube carrying a square axle which operates the opening of said main bolt, an elastically retractable tenon for rotary coupling between said primary and secondary tubes and which works radially and vertically from the inside to the outside through the lateral walls of a part fitted from said primary tube into said secondary tube, a retractor treadle which is guided in said body assembly and lined up and making permanent contact with said retractable tenon through said fitted wall of said secondary tube, a rocker of elastic arms which pushes said retractor treadle and which is acted upon twice and in opposite directions by a motorized actuator and by an emergency lever, an electronic reader of cards with magnetic, optical, proximity code (and in general any type of familiar reader), which activates said motorized actuator when said card is validated, and an emergency lock cylinder for an encoded security key which, when turned, appropriately pushes said emergency lever; and said inner unit has a housing for the electric batteries, an actuating handle, the inner knob mounted in an inner tube which is directly coupled to said square axle and which has two pushing tabs keyed on, symmetrically arranged and mutually opposite, which by the direct or reverse turning of said inner handle each independently act on the end of a rod which turns with a spindle shaft which actuates said privacy bolt; the spindle shaft in its actuation of rotation opposite to the opening also operates a microswitch that sends the electric signal of access restriction corresponding to the privacy desired by the user.

In this embodiment, said retractable tenon has a robust embodiment which is supported against a pushing spring and radially guided with respect to said primary tube between the extended and the retracted positions, which are mechanically limited and such that, in said extended position, said retractable tenon is properly occupying an opening in the wall of said secondary tube and establishing the rotary coupling between said primary and secondary tubes, and in said retracted position said retractable tenon is flush with the fitted periphery of said primary tube, which is rotationally uncoupled from said secondary tube, and in this retracted position said retractor treadle remains in a lower stop position in which it is flush with the inner wall of said secondary tube and remains in the center between two radial lugs of said primary tube in relation to the rotation of this primary tube in both directions. For its part, said retractor treadle can move vertically and be guided in said body assembly between a so-called lower position and an upper position in which it is flush at the bottom with the periphery of said secondary tube; whose lower position of the retractor treadle produces said retracted position of the retractable tenon, determining the rotational uncoupling between said primary and secondary tubes, and this lower position corresponds to a normal position of said rocker, which is contingent upon an inactivated state of said motorized actuator when there is no so-called card with the valid code for opening the controlled access in said electronic reader; whose upper position of the retractor treadle enables said extended position of the retractable tenon in which said rotary coupling is produced between said primary and secondary tubes, and this upper position corresponds to a momentary position of said rocker which is contingent upon a time-activated state of said motorized actuator when said electronic reader recognizes the valid code on a said card. The timing which the presence of the valid card provides to the rotary coupling is brief, but long enough to commence the manipulation of the outer handle.

Besides the vandalism-resisting assembly of armored body, the new closure offers a security device consisting in that the actuation of the outer handle is only transmitted to the lock mechanism when the rotary coupling between the primary and secondary tubes has previously been established; which, for the purposes now under consideration, only occurs when the electronic reader performs the validation of a code card present in same. Consequently, if one tries to violate the closure by forcing the outer handle, one will only succeed in breaking it, but the access will remain closed. The outer handle turns freely as long as there is no rotary coupling between the primary and secondary tubes.

Another security element of the new closure is that the batteries are situated in the inner unit, thus being inaccessible from the outside.

The concept of rotary coupling primary and secondary tubes at the same time ensures that the lock mechanism is independent of the outer and inner units of the closure; so that the new closure has great versatility of application and can be placed on lock mechanisms already installed in access doors formerly lacking a control, by simply assembling the square (standardized) axle emerging from the secondary tube.

The new closure also has a privacy bolt whose actuation is connected to that of the square axle of the main privacy bolt, such that this privacy bolt can be thrown by a turn of the square axle in the direction opposite that of opening of the lock mechanism, and it can be withdrawn (the privacy bolt) by turning the square axle in the direction of opening of the lock mechanism. This actuation link occurs through the rod of the spindle shaft of the privacy bolt, which remains appropriately applied against one or the other of the first and second pushing tabs which turn (one or the other, depending on the direction of turning) along with the square axle. Thus, when the user introduces the valid code card, if the outer handle is turned in said reverse direction the privacy bolt will be thrown; and, this being thrown, the direct turning of the outer handle simultaneously produces the withdrawal of the privacy bolt and of the main bolt of the lock mechanism. Throwing the privacy bolt from the outside allows it to be used to provide a point of closure in addition to the main access security.

The new closure incorporates an emergency device to allow opening from the outside without the need of the card. This emergency device is of mechanical type and has an actuator, likewise encoded, such as a lock cylinder (for an encoded security key) which, when turned, displaces the emergency lever which causes the rocker to tilt in the direction of lifting the retractor treadle to the upper position in which it enables the extended position of the retractable tenon and, accordingly, the rotary coupling between the primary and secondary tubes; by maintaining this position of the lever, it is possible to perform the maneuver of opening with the outer handle. For this, said emergency lever has a pushing part and a pushed part and it is capable of moving between the position of rest and the emergency position; said pushing part being applied against said rocker, opposite to said motorized actuator; said pushing part being in interference with a rotary working course of a cam belonging to said lock cylinder; said position of rest being such that said pushing part is applied against a said rocker situated in its said normal position, and said pushed part is at the start of said working course of said cam; and said emergency position being such that said pushing part is applied against a said rocker situated in its said momentary position, and said pushed part is at the end of said working course of said cam.

The new closure also incorporates a no-panic function which allows the opening from the inner handle in any case. This no-panic function is enabled by the special mechanical device associated with the inner unit, where the tube of the inner handle is directly coupled to the lock mechanism (through the square axle) and the first and second pushing tabs act on the rod of the spindle shaft, which actuates the privacy bolt. Even though the privacy bolt is thrown when the handle is actuated, its retraction occurs simultaneously with the main bolt.

According to another prominent characteristic of the new closure, said lock cylinder has a threaded installation from the front of said body assembly and, on its periphery, this lock cylinder has at least one lengthwise chamfer which, at the end of said threaded installation, is radially opposite the tip of a detent which has a wedge-shaped tail forming an inclined plane, converging backwards, which provides a sliding action relative to the conical tip of a captive screw which is threaded from behind in said body assembly, transversally to said detent, and whose detent is capable of occupying a retracted position and an extended position, which correspond to certain conditions of maximum extension and compression of a retractor spring, in whose retracted position said wedge-shaped tail situates the most forward part, having slid to the broadest part of said conical tip of the captive screw and said tip of the detent is inserted in said longitudinal chamfer.

One should also point out the great structural simplicity and functional efficiency of the new closure, which nonetheless furnishes such broad and complete performance.

DRAWINGS AND REFERENCES

To better understand the nature of the present invention, on the enclosed drawings we represent a preferable industrial embodiment, which has the nature of a purely illustrative and not limiting example.

FIG. 1 an exploded and perspective view which shows the makeup of the new closure, particularly applied to a door (3) outfitted with a lock mechanism (4) which compactly integrates the main bolt **(4*a*) and privacy bolt (4*b*); the first, of latch type, and the second, in its retracted or withdrawn position. In enlarged manner, there is included a scheme of the internal mechanism of the outer unit (1), viewed dorsally as indicated by the arrow; here, one can note the characteristic two-way operation in opposite directions provided by the motorized actuator (13) and the emergency lever (14) against the rocker (12), which pushes the retractor treadle (11); the solid line represents the positions corresponding to the state of rotary uncoupling between the primary tube (6) and the secondary tube (8); and the broken line represents the positions of rotary coupling of same, both that produced by the lowering of the motorized actuator (13) and that produced by the lifting of the emergency lever (14)**.

EXPLANATION OF A PREFERRED EMBODIMENT

Figure 1B:
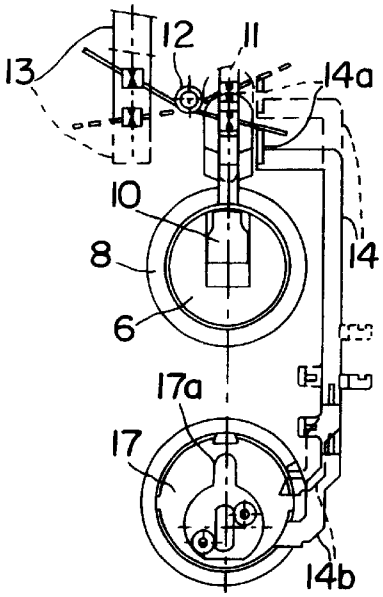
Figure 1A:
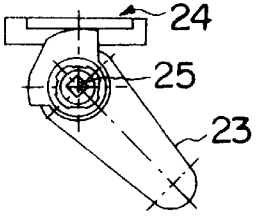

With respect to the drawings and references enumerated above, a preferred mode of execution is illustrated on the enclosed plans, referring to a new security closure for access control, which functions by means of a magnetically or optically encoded card (16). The validation of the card (16) (by an electronic reader of the security closure itself) makes it possible to open a lock mechanism (4) installed in the door (3) during a brief period of time, established with sufficient length to initiate the corresponding maneuver without haste.

The new closure comprises an outer unit (1) and an inner unit (2), installed on the respective outside and inside of a door (3) for mechanical actuation of the opening turning of a lock mechanism (4); with various possible configurations, which is accommodated in the body of said door (3) and has a main bolt (4*a*) and a privacy bolt (4*b*); said outer unit (1) having an armored body assembly (5), a primary tube (6) carrying an outer actuating handle (7), or knob, a secondary tube (8) carrying a square axle (9) which produces the opening of said main bolt (4*a*), an elastically retractable tenon (10) for rotary coupling between said primary tube (6) and secondary tube (8) and which acts radially and vertically from the inside to the outside via the lateral walls of a fitted portion of said primary tube (6) in said secondary tube (8), a retractor treadle (11) which is guided in said body assembly (5) and lined up in permanent contact with said retractable tenon (10) by means of said fitted wall of said secondary tube (8), a rocker (12) of elastic arms which pushes said retractor treadle (11) and which is two-way operated in opposite directions by a motorized actuator (13) and by an emergency lever (14), an electronic reader (15) of cards with magnetic or optical code (16) which activates said motorized actuator (13) upon validating a said card (16), and an emergency lock cylinder (17) for an encoded security key which, when turned, appropriately pushes said emergency lever (14); and said inner unit (2) has a housing (18) for the electric batteries, an inner actuating handle (19), or knob, mounted in an inner tube (20), which is directly coupled to said square axle (9) and which has two first (21) and second (22) pushing tabs keyed on, symmetrically arranged in mutual opposition, which act independently of each other with the direct or opposite turning of said inner handle (19) on the end of a rod (23) which turns with a spindle shaft (25) which actuates said privacy bolt (4*b*).

According to the invention, said retractable tenon (10) has a robust constitution that is supported against a pushing spring (26) and radially guided with respect to said primary tube (6) between an extended position and a retracted position, which are mechanically limited and such that, in said extended position, said retractable tenon (10) properly occupies an opening (27) in the wall of said secondary tube (8) and establishes the rotary coupling between said primary tube (6) and secondary tube (8), and in said retracted position, said retractable tenon (10) is flush with the fitted periphery of said primary tube (6), which is rotationally uncoupled from said secondary tube (8), and in this retracted position said retractor treadle (11) remains in a lower stop position in which it is flush with the inner wall of said secondary tube (8) and remains in the center between two radially lugs (28) of said primary tube (6) with respect to the rotation of this primary tube (6) in both directions.

Also according to the invention, said retractor treadle (11) can move vertically and is guided in said body assembly (5) between a said lower position and an upper position in which it is flush at the bottom with the periphery of said secondary tube (8); whose lower position of the retractor treadle (11) produces said retracted position of the retractable tenon (10), responsible for the rotational uncoupling between said primary tube (6) and secondary tube (8), and this lower position corresponds to a normal position of said rocker (12), which is contingent upon an inactivated state of said motorized actuator (13) when there is no said card (16) with valid code for opening the controlled access in said electronic reader (15); whose upper position of the retractor treadle (11) enables said extended position of the retractable tenon (10) in which said rotational coupling occurs between said primary tube (6) and secondary tube (8), and this upper position corresponds to a momentary position of said rocker (12) which is contingent upon a time-activated state of said motorized actuator (13), when said electronic reader (15) recognizes the valid code on a said card (16).

Figure 1:
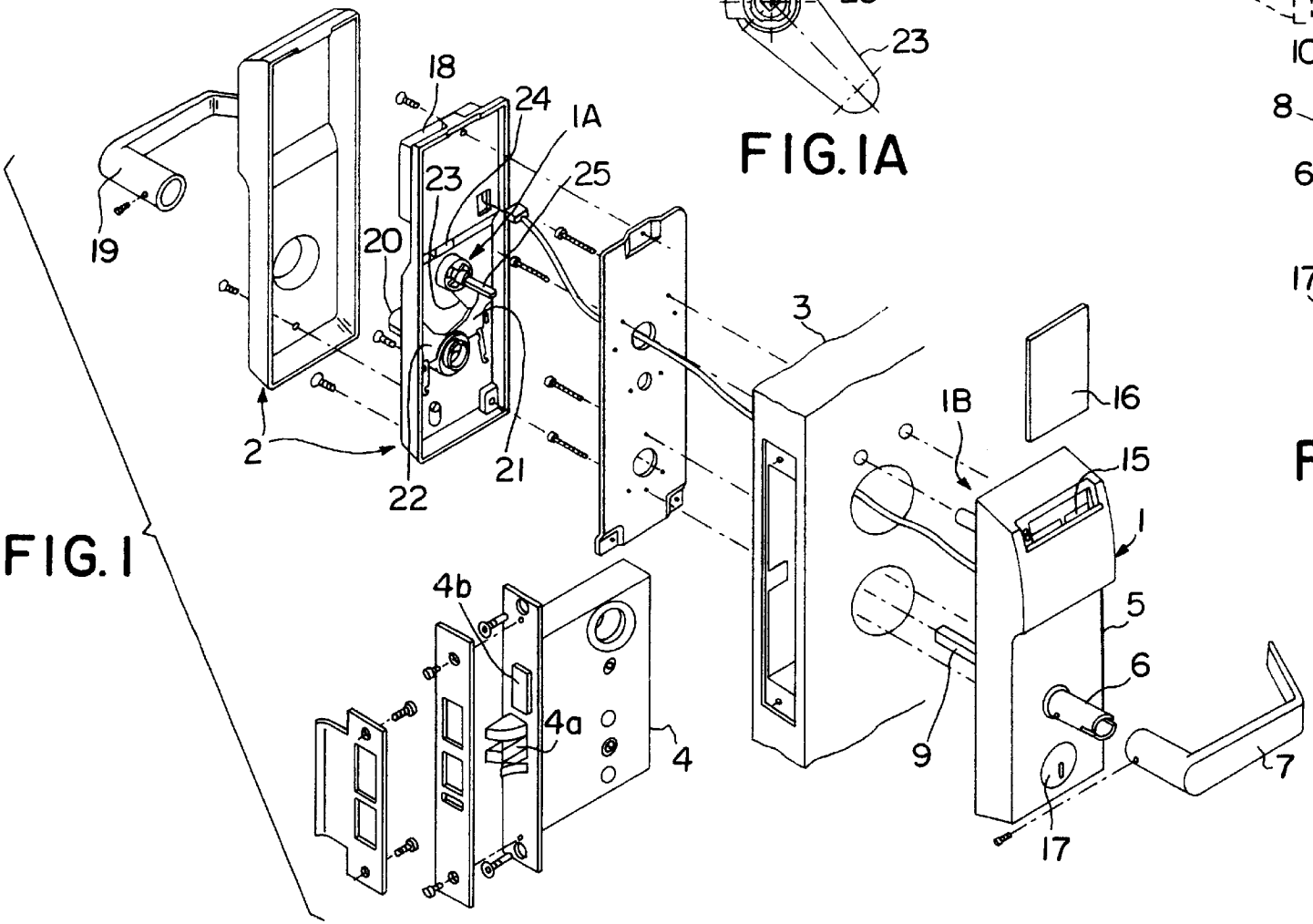
Figure 2:
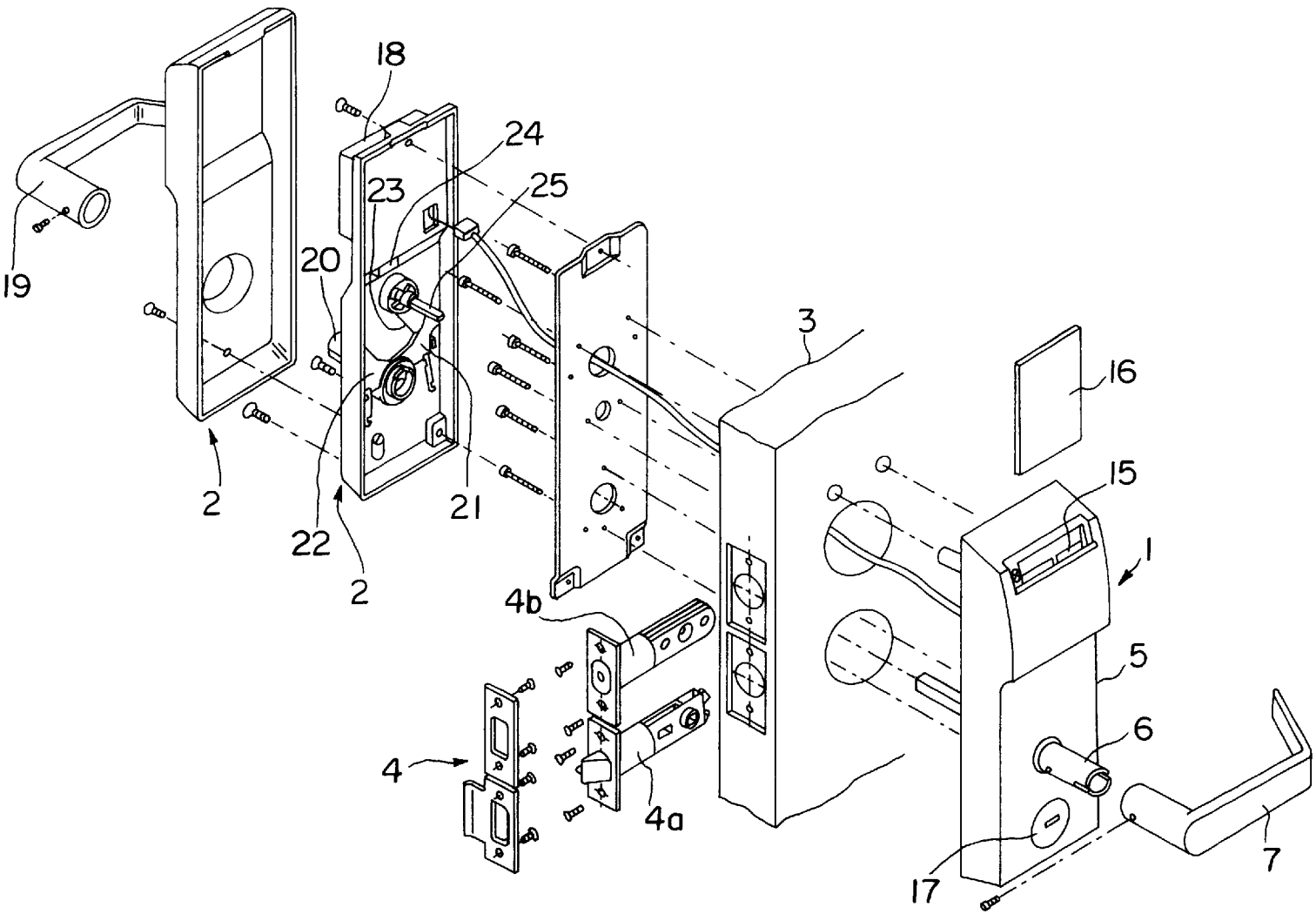
FIG. 2 is an exploded perspective view like FIG. 1, showing one of the possible options in which the door (3) is outfitted with a lock mechanism (4) in which the main bolt **(4*a*) and the privacy bolt (4*b*)** are separate elements.
Figure 3:
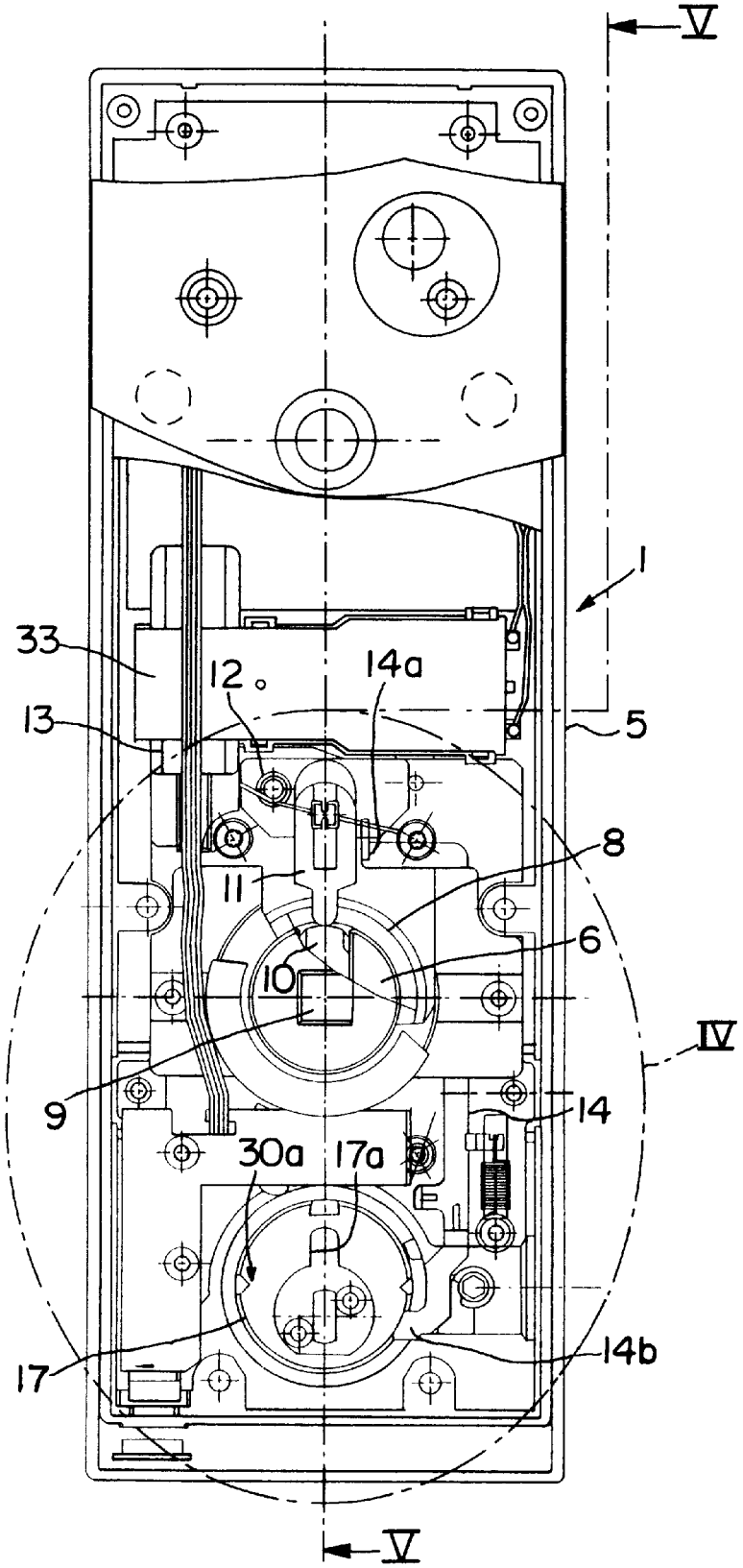
FIG. 3 is a dorsal end view of the outer unit (1), where the rear walls have been conventionally eliminated in part to allow visual access to the device shown schematically in FIG. 1.
Figure 4:
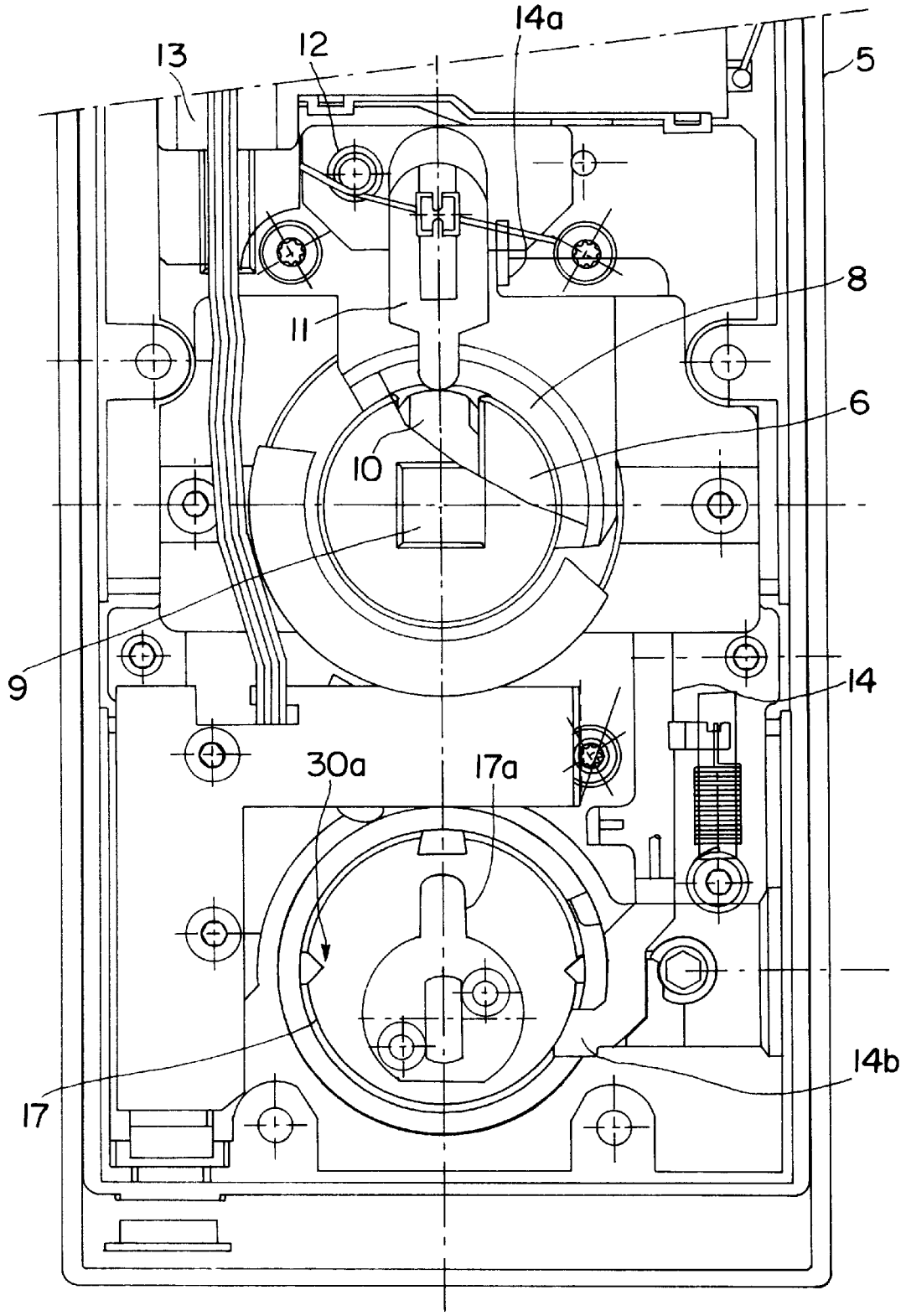
FIG. 4 is an enlargement of feature IV which appears encircled in FIG. 3.
Figure 5:
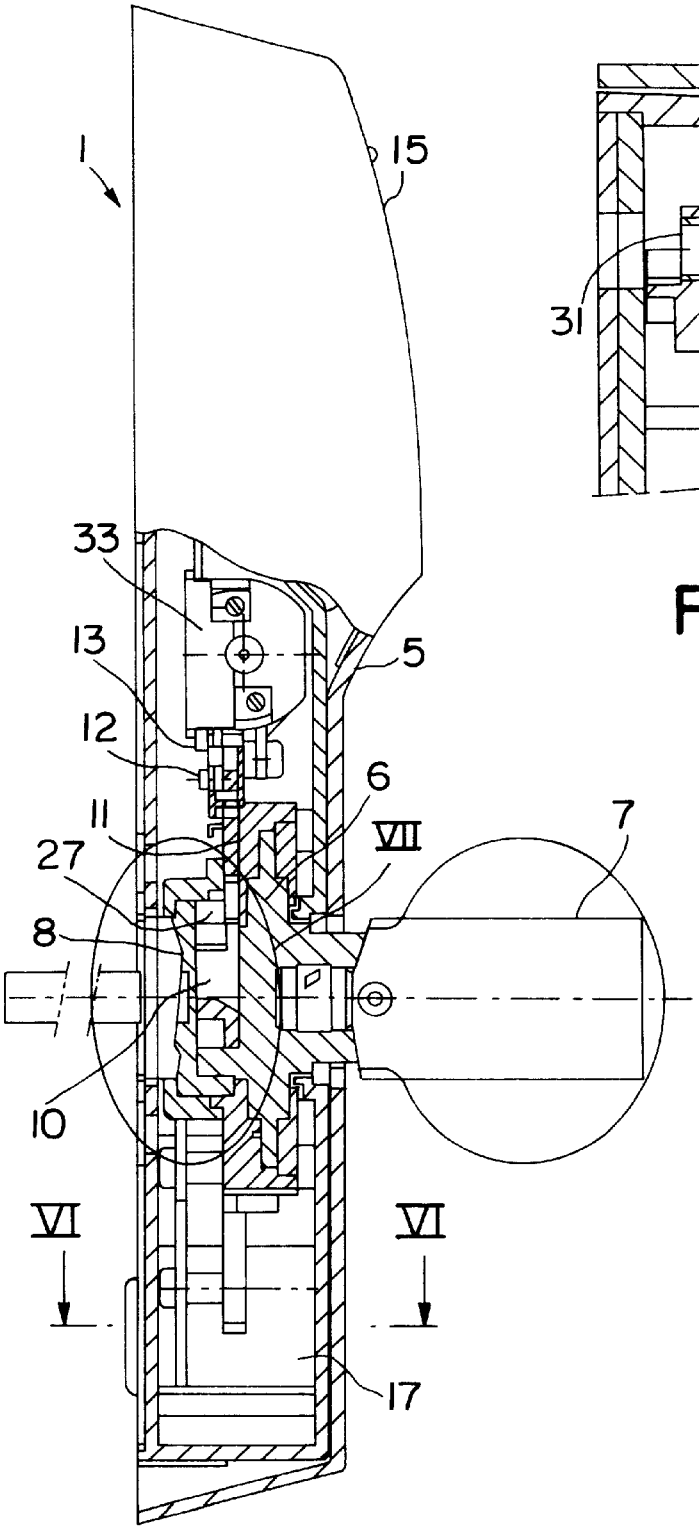
FIG. 5 is section V—V which is indicated in FIG. 3.
Figure 9:
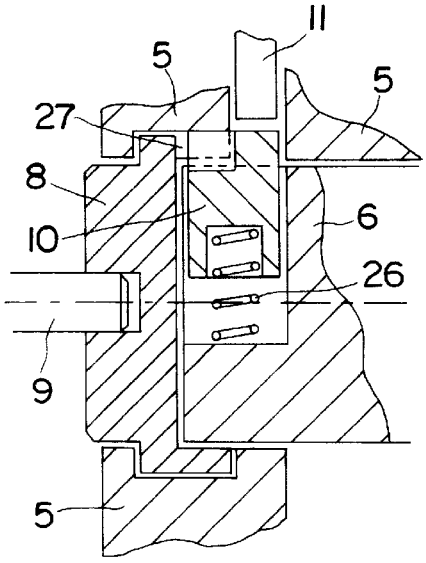
FIGS. 9 and 10 are respectively analogous to FIGS. 7 and 8, but now showing the position of coupling between the primary tube (6) and secondary tube (8).
Figure 10:
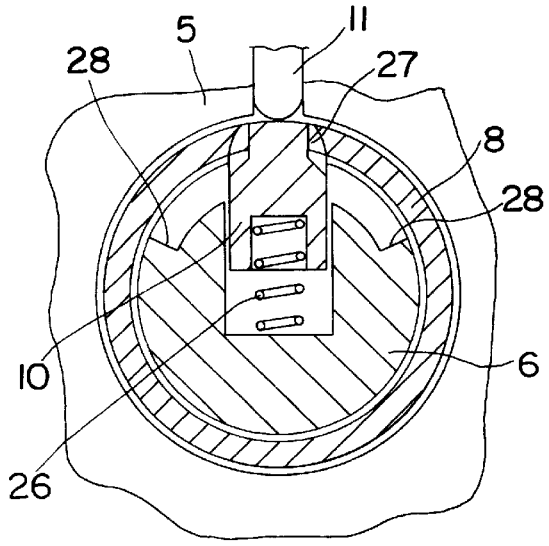

The functionality of that which emerges from what has been set forth up to now shall be summarized hereafter. The starting condition is the state of rest as represented by FIGS. 3, 4, 5, 7 and 8, in which the primary tube (6) and secondary tube (8) are rotationally uncoupled, because the retractable tenon (10) is (FIGS. 7 and 8) in its retracted position (compressing the pushing spring 26), since the retractor treadle (11) is in its lower position which is produced by a respective position of the rocker (12) which, in turn, is determined by the position of the motorized actuator (13). When the electronic reader (15) validates a code card (16), for a sufficient predetermined time the motorized actuator (13) descends, causing the rocker (12) to tilt in the direction (position of [broken] lines of FIG. 1) of lifting the treadle (11) to its upper position in which (FIGS. 9 and 10) it allows the tenon (10), radially guided in the primary tube (6), to become situated (by its tip) likewise through the opening (27) of the secondary tube (8); such that these tubes (6, 8) are rotationally coupled and, when the outer handle (7) is turned, the square axle (9) produces a retraction of the main bolt (4*a*) of the lock mechanism (4). In this maneuver, the square axle (9) also causes the second pushing tab (22) (FIG. 1) of the lower unit (2) to turn, but this is not translated into any effect on the privacy bolt (4*b*) because, since it has not been thrown, the rod (23) of the spindle shaft (25) is applied against the first pushing tab (21); if the privacy bolt (4*b*) were thrown, the rod (23) would have been applied against the second pushing tab (22) and in the same maneuver this privacy bolt (4*b*) would also have been retracted. On the other hand, if the initial turning of the outer handle (7) had occurred in the opposite direction, it would have resulted in throwing the privacy bolt (4*b*) from the outside; which has the benefit already mentioned of establishing an additional point of closure (besides the main bolt—4*a*) when the premises under access control are being abandoned.

As for the actuation from the inner handle (19), the opening implicitly has the no-panic function, since it will always be possible to open because the inner tube (20) is permanently connected in turning with the square axle (9), which retracts the main bolt (4*a*) and, on the other hand, if the privacy bolt (4*b*) were thrown, it would be simultaneously retracted with the other one in the same way as explained for the case of actuation on the outer handle (7).

In cases of emergency, it may be necessary to open from the outside without having the valid code card (16); the lock cylinder (17) is then used. In this regard, said emergency lever (14) has certain pushing (14*a*) and pushed (14*b*) parts and is capable of movement between a position of rest and an emergency position; said pushing part (14*a*) being applied to said rocker (12) opposite said motorized actuator (13); said pushed part (14*b*) being in interference with a rotary working segment of a cam (17*a*) belonging to said lock cylinder (17); said position of rest being such that said pushing part (14*a*) is applied against a said rocker (12), situated in its said normal position, and said pushed part (14*b*) is at the beginning of said working segment of said cam (17*a*); and said emergency position being such that said pushing part (14*a*) is applied against a said rocker(12), situated in its momentary position, and said pushed part (14*b*) is at the end of said working segment of said cam (17*a*). The sequence of the maneuver is verified by commencing the turning of the outer handle (7) while the cam (17*a*) of the cylinder (17) maintains the displaced position (backward, in this embodiment) of the emergency lever (14).

Figure 6:
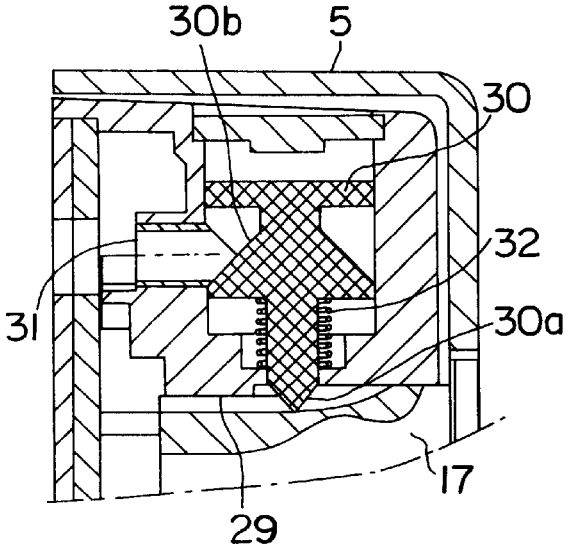
FIG. 6 is an enlargement of section VI—VI, which appears marked in FIG. 5 and which illustrates the assembly of the lock cylinder (17) frustrating disassembly from the front.
Figure 7:
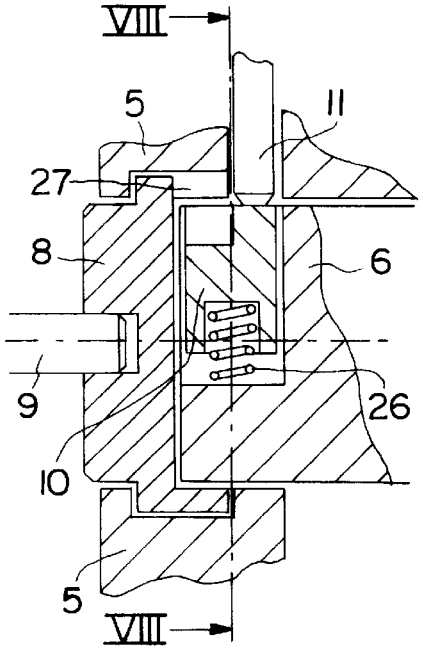
FIG. 7 is an enlargement of feature VII, which is indicated in FIG. 5, and shows the position of rotary uncoupling between the primary tube (6) and the secondary tube (8).
Figure 8:
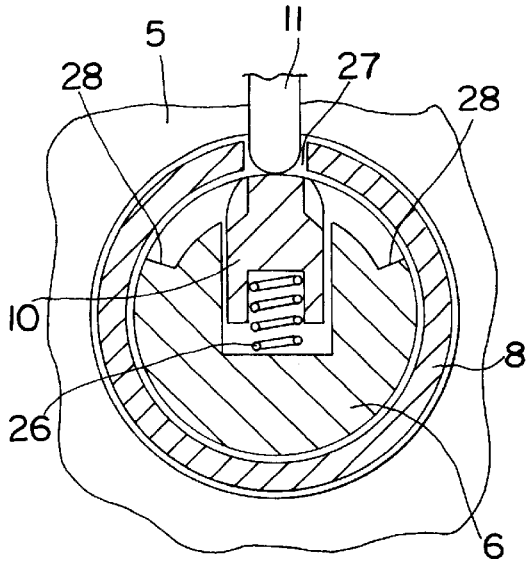
FIG. 8 is section VIII—VIII indicated in FIG. 7.

The lock cylinder (17) is put in place and removed through the front of the body assembly (5), but once installed in the outer unit (1) it can only be disassembled by first acting through the rear wall of this outer unit (1). This is because said lock cylinder (17) has a threaded assembly from the front of said body assembly (5) and, at its periphery, this lock cylinder (17) has at least one lengthwise chamfer (29) which, at the end of said threaded installation, ends up radially opposite the tip (30*a*) of a detent (30) which has a wedge-shaped tail (30*b*), forming an inclined plane converging backward, which produces sliding with respect to the conical tip of a captive screw (31), which threads from behind in said body assembly (5) transversally to said detent (30), and whose detent (30) is capable of occupying a retracted position and an extended position which correspond to certain states of maximum extension and compression of a retractor spring (32), in whose retracted position said wedge-shaped tail (30*b*) situates the forwardmost part of its inclined plane facing the zone adjacent to the vertex of said conical tip of the captive screw (31), and in whose extended position said wedge-shaped tail (30) has its said front part having slid as far as the broadest part of said conical tip of the captive screw (31) and said tip (30*a*) of the detent (30) is inserted in said lengthwise chamfer (29). The installation sequence is to thread the cylinder (17) in the cavity of the body assembly (5) and through the front of the latter, when the captive screw (31) is removed and, by the action of the retractor spring (32), the detent (30) is retracted without its tip (30*a*) appearing in the hollow of the body assembly (5), which is reserved for the cylinder (17); once the cylinder (17) is threaded, upon threading the captive screw (31) its conical tip impinges laterally against the inclined plane which causes the tip (30*a*) to appear and penetrate radially into the corresponding lengthwise chamfer (29), so that (FIG. 6) it is no longer possible to unscrew the cylinder (17) or, for that matter, extract it through the front, as long as the captive screw (31) has not been removed and the initial situation restored. It is envisioned to have more than one of these arrangements of lengthwise chamfer/detent/captive screw (29-30-31).

In the models with only one main bolt, it is envisioned that there can be an inner privacy blocking with a toggle or the like, joined to the spindle shaft (25), which actuates a microswitch (24) to limit the access.

The nature of the present invention being sufficiently described, as well as its industrial embodiment, it only remains to add that it is possible to introduce changes of shape, material and arrangement in its totality and constituent parts, staying within the scope of the invention, as long as such changes do not vitiate its essence.

I claim:

1. A security closure locking assembly for controlling access, comprising an outer unit (1) and an inner unit (2) for installation on the respective outside and inside of a door (3) for mechanical actuation of the opening turning of a lock mechanism (4) and having a main bolt (4*a*) and a privacy bolt (4*b*); said outer unit (1) having an armored body assembly (5), a primary tube (6) carrying an outer actuating handle (7), a secondary tube (8) having an inner wall, an outer wall and an opening (27) and carrying a square axle (9) which produces the opening of said main bolt (4*a*), said primary tube (6) having a fitted periphery within said secondary tube (8), an elastically retractable tenon (10) for rotary coupling between said primary tube (6) and said secondary tube (8) and which acts radially and vertically from the inside of said primary tube (6) to the outside of said primary tube (6), a retractor treadle (11) which is guided in said body assembly (5) and aligned in permanent contact with said retractable tenon (10) through said opening (27) in said secondary tube (8), a rocker (12) having elastic arms for biasing said retractor treadle (11), said rocker (12) being adapted to be actuated in opposite directions by a motorized actuator (13) and by an emergency lever (14), an electronic reader (15) of cards having a magnetic or optical code (16) for activating said motorized actuator (13) upon validating said card (16), and an emergency lock cylinder (17) for an encoded security key adapted to push said emergency lever (14); said inner unit (2) having a housing (18) for batteries and an inner tube (20) having an inner actuating handle (19) mounted therein and which is directly coupled to said square axle (9), said inner tube (20) having first and second pushing tabs (21) symmetrically arranged in mutual opposition, said pushing tabs (21) acting independently of each other in response to the direct or opposite turning of said inner actuating handle (19) to actuate said privacy bolt (4*b*).

2. A security closure locking assemble in accordance with claim 1, characterized in that said retractable tenon (10) is supported against a pushing spring (26) and radially guided with respect to said primary tube (6) between an extended position and a retracted position, which are mechanically limited and such that, in said extended position, said retractable tenon (10) properly occupies said opening (27) in said secondary tube (8) and establishes the rotary coupling between said primary tube (6) and said secondary tube (8), and in said retracted position, said retractable tenon (10) is flush with said fitted periphery of said primary tube (6) such that said primary tube is rotationally uncoupled from said secondary tube (8), and in this retracted position said retractor treadle (11) remains in a lower stop position in which it is flush with said inner wall of said secondary tube (8) and remains in the center between two radial lugs (28) of said primary tube (6) with respect to the rotation of said primary tube (6) in both directions.

3. A security closure locking assembly in accordance with claim 1, characterized in that said retractor treadle (11) is adapted to move vertically and is guided in said body assembly (5) between a lower position and an upper position in which it is flush with said outer wall of said secondary tube (8); said lower position of said retractor treadle (11) producing a retracted position of said retractable tenon (10), responsible for the rotational uncoupling between said primary tube (6) and secondary tube (8), and said lower position corresponding to a normal position of said rocker (12), which is contingent upon an inactivated state of said motorized actuator (13) when there is no said card (16) with valid code for opening the controlled access in said reader (15); said upper position of said retractor treadle (11) enabling an extended position of said retractable tenon (10) in which said rotational coupling occurs between said primary tube (6) and secondary tube (8), and said upper position corresponding to a momentary position of said rocker (12) which is contingent upon a time-activated state of said motorized actuator (13), when said reader (15) recognizes the valid code on said card (16).

4. A security closure locking assembly in accordance with claim 1, wherein said lock cylinder (17) has a cam (17*a*) having a rotary working segment having a beginning position and an end position, and wherein said rocker has a normal position and an emergency position, said security closure locking assembly being characterized in that said emergency lever (14) has pushing (14*a*) and pushed (14*b*)

parts and is capable of movement between a position of rest and an emergency position; said pushing part (14*a*) being applied to said rocker (12) opposite said motorized actuator (13); said pushed part (14*b*) being in interference with said rotary working segment of said cam (17*a*) of said lock cylinder (17); said position of rest being such that said pushing part (14*a*) is applied against said rocker (12), situated in its said normal position, and said pushed part (14*b*) is at said beginning position of said working segment of said cam (17*a*); and said emergency position being such that said pushing part (14*a*) is applied against said rocker (12), situated in its said momentary position, and said pushed part (14*b*) is at said end position of said working segment of said cam (17*a*).

5. A security closure locking assembly in accordance with claim 1, wherein said body assembly has a front, and wherein said locking assembly further comprises a captive screw (31) having a conical tip, and a detent (30) in said body assembly (5), said detent (3) having a tip and a wedge-shaped tail (30*b*) defining an inclined plane adapted to be engaged by said conical tip of said captive screw (31), thereby causing said detent (30) to slide between a retracted position when said inclined plane is not engaged by said conical tip and an extended position when said inclined plane is engaged by said conical tip, said captive screw (31) threading in said body assembly (5) transversely to said detent (30), characterized in that said lock cylinder (17) is threaded into said front of said body assembly (5) and, at its periphery, said lock cylinder (17) has at least one lengthwise chamfer (29) at least a portion of which radially opposite said tip (30*a*) of said detent (30), whereby when said detent (30) is in said extended position, said tip (30*a*) of said detent (30) is inserted in said lengthwise chamfer (29).

6. Security closure for control of access, in accordance with claim 2, characterized in that said retractor treadle (11) can move vertically and is guided in said body assembly (5) between a said lower position and an upper position in which it is flush at the bottom with the periphery of said secondary tube (8); whose lower position of the retractor treadle (11) produces said retracted position of the retractable tenon (10), responsible for the rotational uncoupling between said primary tube (6) and secondary tube (8), and this lower position corresponds to a normal position of said rocker (12), which is contingent upon an inactivated state of said motorized actuator (13) when there is no said card (16) with valid code for opening the controlled access in said electronic reader (15); whose upper position of the retractor treadle (11) enables said extended position of the retractable tenon (10) in which said rotational coupling occurs between said primary tube (6) and secondary tube (8), and this upper position corresponds to a momentary position of said rocker (12) which is contingent upon a time-activated state of said motorized actuator (13), when said electronic reader (15) recognizes the valid code on a said card (16).

7. Security closure for control of access in accordance with claim 2, characterized in that said emergency lever (14) has certain pushing (14*a*) and pushed (14*b*) parts and is capable of movement between a position of rest and an emergency position; said pushing part (14*a*) being applied to said rocker (12) opposite said motorized actuator (13); said pushed part (14*b*) being in interference with a rotary working segment of a cam (17*a*) belonging to said lock cylinder (17); said position of rest being such that said pushing part (14*a*) is applied against a said rocker (12), situated in its said normal position, and said pushed part (14*b*) is at the beginning of said working segment of said cam (17*a*); and said emergency position being such that said pushing part (14*a*) is applied against a said rocker (12), situated in its momentary position, and said pushed part (14*b*) is at the end of said working segment of said cam (17*a*).

8. Security closure for control of access in accordance with claim 3, characterized in that said emergency lever (14) has certain pushing (14*a*) and pushed (14*b*) parts and is capable of movement between a position of rest and an emergency position; said pushing part (14*a*) being applied to said rocker (12) opposite said motorized actuator (13); said pushed part (14*b*) being in interference with a rotary working segment of a cam (17*a*) belonging to said lock cylinder (17); said position of rest being such that said pushing part (14*a*) is applied against a said rocker (12), situated in its said normal position, and said pushed part (14*b*) is at the beginning of said working segment of said cam (17*a*); and said emergency position being such that said pushing part (14*a*) is applied against a said rocker (12), situated in its momentary position, and said pushed part (14*b*) is at the end of said working segment of said cam (17*a*).

9. A security closure locking assembly in accordance with claim 1, wherein said direct or opposite turning of said inner actuating handle (19) turns a spindle shaft (25) which actuates said privacy bolt (4*b*), said opposite turning of said inner actuating handle (19) causing said spindle shaft (25) to actuate a microswitch (24).

* * * * *